US006656536B2

(12) United States Patent
Mauchle

(10) Patent No.: US 6,656,536 B2
(45) Date of Patent: Dec. 2, 2003

(54) METHOD OF CONTROLLING SPRAY CURRENT AND VOLTAGE IN ELECTROSTATIC COATING APPARATUS

(75) Inventor: Felix Mauchle, Abtwil (CH)

(73) Assignee: ITW Gema AG, St. Gallen (CH)

( * ) Notice: Subject to any disclaimer, the term of this patent is extended or adjusted under 35 U.S.C. 154(b) by 0 days.

(21) Appl. No.: 10/314,356

(22) Filed: Dec. 9, 2002

(65) Prior Publication Data

US 2003/0064167 A1 Apr. 3, 2003

Related U.S. Application Data

(62) Division of application No. 09/593,297, filed on Jun. 13, 2000, now Pat. No. 6,537,378.

(30) Foreign Application Priority Data

Jun. 14, 1999 (DE) ..... 199 26 926

(51) Int. Cl.[7] ..... B05D 1/04

(52) U.S. Cl. ..... 427/458; 427/475; 427/479; 427/483; 427/8

(58) Field of Search ..... 427/458, 475, 427/477, 479, 480, 483–486, 8; 118/712, 663, 671, 679, 629

(56) References Cited

U.S. PATENT DOCUMENTS

| | | | | |
|---|---|---|---|---|
| 3,893,006 | A | | 7/1975 | Algeri et al. |
| 4,000,443 | A | | 12/1976 | Lever |
| 4,075,677 | A | | 2/1978 | Bentley |
| 4,187,527 | A | | 2/1980 | Bentley |
| 4,266,262 | A | * | 5/1981 | Haase, Jr. |
| 4,764,393 | A | | 8/1988 | Henger et al. |
| 5,251,356 | A | | 10/1993 | Oaki et al. |
| 5,584,931 | A | | 12/1996 | Buhlmann |
| 5,720,436 | A | | 2/1998 | Buschor |
| 5,735,958 | A | | 4/1998 | Mauchle |
| 6,047,431 | A | | 4/2000 | Canonica |
| 6,068,877 | A | * | 5/2000 | Seitz et al. |

FOREIGN PATENT DOCUMENTS

| | | | |
|---|---|---|---|
| DE | 3445946 | A1 | 6/1986 |
| DE | 2759787 | C2 | 12/1988 |
| EP | 0 160 179 | B1 | 10/1988 |
| EP | 1 60 179 | * | 10/1988 |
| EP | 0 620 045 | A1 | 10/1994 |
| EP | 0 626 209 | A1 | 11/1994 |
| EP | 0 559 608 | B1 | 12/1995 |
| EP | 0 626 208 | B1 | 11/1998 |
| EP | 899 020 | * | 3/1999 |
| EP | 073477 | A2 | 10/1999 |
| GP | 2 077 006 | | 12/1981 |
| WO | WO 99/25483 | | 5/1999 |

OTHER PUBLICATIONS

Patent Abstracts of Japan, vol. 1997, No. 02, Feb. 28, 1997 & JP 8–275917 Oct. 22, 1996, Fig. 1.
Patent Abstracts of Japan, vol. 18, No. 248 May 12, 1994 & JP 6–030899 Feb. 8, 1994, Fig. 1.

* cited by examiner

*Primary Examiner*—Fred J. Parker
(74) *Attorney, Agent, or Firm*—Lowe Hauptman Gilman & Berner LLP

(57) ABSTRACT

A method of ensuring safety in operation of a coating apparatus includes the steps of measuring an instant value of a spray current, and regulating the spray current so that the spray current does not exceed a predetermined spray current limiting value by adjusting the high voltage applied to an electrode of the apparatus based on the measured instant value of the spray current. The spray current is directly measured in a return path of electrical current from the object to a regulating circuit of the apparatus.

12 Claims, 2 Drawing Sheets

METHOD OF CONTROLLING SPRAY CURRENT AND VOLTAGE IN ELECTROSTATIC COATING APPARATUS

This application is a divisional of application Ser. No. 09/593,297 filed Jun. 13, 2000 U.S. Pat. No. 6,537,378.

The invention relates to a spray-coating apparatus with direct spray current measurement.

BACKGROUND ART

Spray-coating equipment is known from the European patent document 0,160,179 B1. Through a keypad, an operator applies a desired voltage and a desired electric current that shall be kept constant by a regulation system. A threshold value applies to the distance between the spray equipment and the object to be coated. If the distance exceeds the threshold value, the high voltage at the high-voltage electrode of the spray equipment is kept constant independently of increasing object distance, the electric spray current of the high-voltage electrode decreasing as the object distance increases and increasing as it becomes smaller. When the distance is less than the said threshold value, the electric spray current is kept constant independently of changes in this distance because an increase in current being counteracted by a commensurate drop in voltage. Just before the object comes into contact with the spray equipment, the high voltage collapses entirely (contact protection). The electric current between the electrode and the object to be coated is determined indirectly by measuring the electric current in the primary of a transformer of which the secondary feeds a high-voltage cascaded circuit having rectifiers and capacitors generating the electrode's high DC voltage DC.

U.S. Pat. No. 4,000,443 discloses spray equipment wherein a rise in the electric spray current when an object to be coated nears said equipment is counteracted by a commensurate reduction in the high voltage. The electric spray current is measured indirectly by the current in the secondary between the transformer and the high-voltage cascaded circuit. The European patent document 0,626,208 B1 discusses spray equipment wherein again the input voltage at a high-voltage generator is varied inversely to the current, the electric spray current being measured indirectly as a voltage drop across a resistor preceding the high-voltage electrode. It is known from the British patent 2,077,006 to counteract a rise in the electrode spray current by commensurately reducing the level of the high voltage within a predetermined operational window. U.S. Pat. No. 4,187,527 compares test values of electric spray currents measured in rapid succession when there is a sharp current rise indicating a short, in order to shut off the current.

The European patent document 0,559,608 B1 discloses measuring the current between the high-voltage electrode and the object to be coated using a meter mounted in the electrical path between said object and ground.

SUMMARY OF THE INVENTION

The objective of the invention is to solve the problem of preventing the dangers relating to excessively high voltages at the high-voltage electrode when there is a large distance from an electrically conducting object, or an excessively high current, or short, when the object is too near the object, where the object may be something to coat or an operator or something else, and at the same time to design the spray coating apparatus in such manner that optimal coating shall be achieved at minimal energy consumption.

This problem is solved by direct measurement of the electric spray current in the return path from the object to be coated. As a result, true test results are provided and rapid response of the regulation system to deviations of instantaneous values from the reference values is achieved.

On account of the invention, using a direct measurement of the electric spray current, true test results are provided and rapid response of the regulation system to deviations of instantaneous values from the reference values is achieved.

In especially advantageous manner of the invention, it contains a counter electrode at a potential substantially differing from that of the high-voltage electrode and for instance at ground in order that free electric particles, in particular that freely wandering ions and electrodes produced by the high-voltage electrode shall be shunted instead of accompanying the spray-coating material from the spray apparatus onto the object to be coated. Counter electrodes are known for instance from the European patent document 0,756,899 A2.

BRIEF DESCRIPTION OF THE DRAWINGS

The invention is elucidated below by means of an illustrative embodiment shown in the attached drawings.

DETAILED DESCRIPTION OF THE INVENTION

Figure 1:
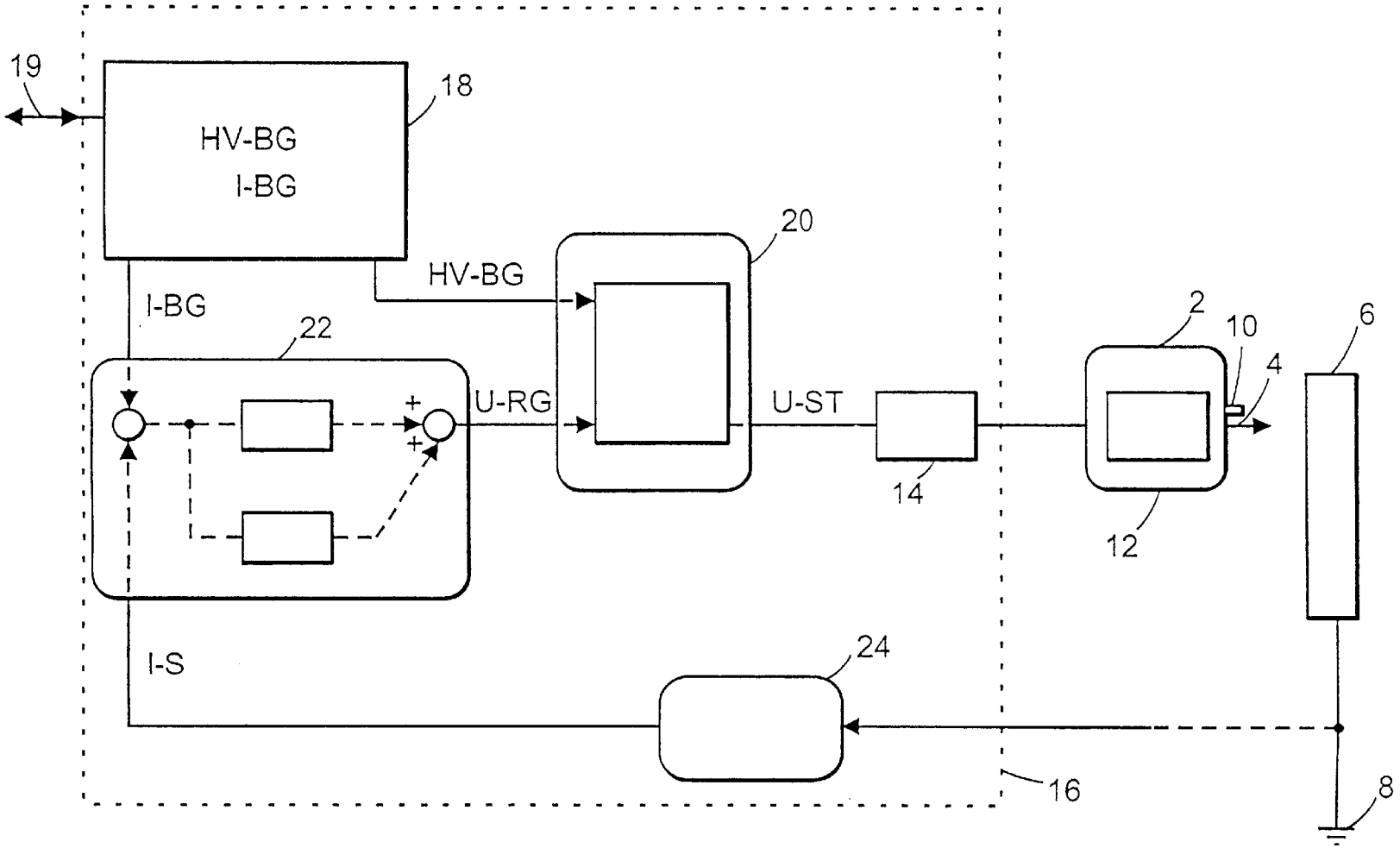
FIG. 1 is a block diagram of the spray coating apparatus of the invention.

The spray-coating apparatus shown in block form in FIG. 1 comprises a spray nozzle 2 to spray a liquid or preferably powder material 4 on an object 6 to be coated. It is assumed that the objects to be coated are electrically conducting and are at ground 8. In automated facilities, the objects 6 are moved by an omitted conveyor past the spray nozzle 2 and in this manner enter a spray jet denoted by the arrow of the coating material 4.

The nozzle 2 is fitted with at least one high-voltage electrode 10 for the purpose of electrostatically charging the coating material 4 and with a high DC voltage source 12 delivering a high DC voltage which is preferably within the range from 1 to 150 kv and is applied to said electrode. The high-voltage source may be a conventional transformer to step up a low AC voltage into a higher one and a cascaded circuit which contains in manner known per se a plurality of rectifiers and capacitors and converts the AC into the high-voltage DC.

The low-voltage AC is generated by an oscillator 14 as a function of a control voltage U-ST controlling the high-voltage applied to the high-voltage electrode 10. The oscillator 14 may be part of the high-voltage source 12 and as such may be integrated into the nozzle 2, or, as shown in FIG. 1, it may be integrated into a control unit which as a whole operates as a regulation system 16.

The regulation system 16 contains an operational-parameter memory 18. At least one variably adjustable high-voltage limit-value HV-BG and at least one electric-spray current limit-value I-BG for the maximum possible values at the high voltage electrode can fed through a data transfer path 19 into said memory 18 and be stored in it. Preferably several such values relating to different operational states, in particular to different objects to be coated and to different spray materials, can be stored in said memory. In another embodiment of the invention, said stored values may be immutably fixed values.

The operational-parameters memory 18 feeds the high-voltage limit value HV-BG into a high-voltage limiting circuit 20. The limiting-value I-BG for the electric spray current is fed from the operational parameters memory 18 to an electric spray current regulator 22.

The electric spray current of the high-voltage electrode 10 from an object to be coated 6 to ground 8 is measured by an electric-spray current circuit 24 on the side of the object 6 connected to ground and is fed also as the instantaneous electric-spray-current value I-S to the electric-spray-current regulator.

The electric-spray-current regulator 22 compares the instantaneous electric-spray current I-S with the electric-spray-current limiting value I-BG and as a function of this comparison generates a high-voltage regulating value U-RG which is applied from the electric-spray current regulator 22 to the high-voltage limiting-circuit 20. Preferably the electric-spray-current regulator 22 is a PI (proportional integral) control.

As a function of the high-voltage limiting value HV-BG and of the high-voltage regulator value U-RG, the high-voltage limiting circuit 20 generates the control voltage U-ST which, in the form of a DC input voltage is fed to the oscillator 14 and represents the high-voltage setpoint for the high-voltage electrode 10.

In the event the high-voltage regulator value U-RG is larger than or equal to the high-voltage limiting value HV-BG, the high-voltage limiting circuit 20 assures that the DC value of the control voltage U-ST shall be equal to the high-voltage limiting value HV-BG. Moreover the high-voltage limiting circuit 20 assures that, in all cases of the high-voltage regulator value U-RG being smaller than the high-voltage limiting value HV-BG, the control voltage U-ST shall be equal to the high-voltage regulator value U-RG. These constraints may be stated as follows:

when U-RG≧HV-BG then U-ST=HV-BG otherwise U-ST=U-RG.

Figure 2:
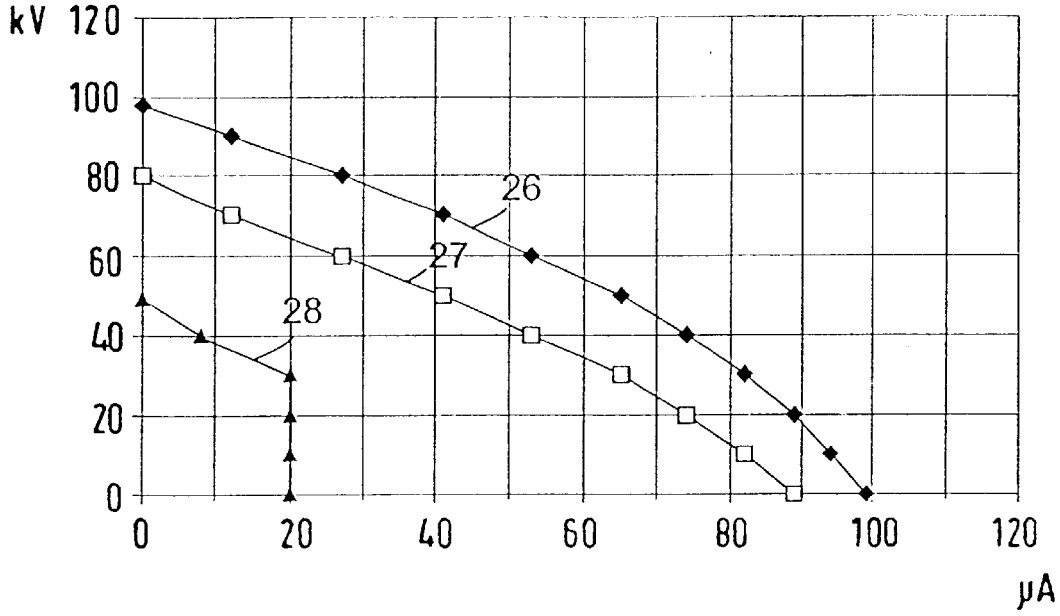
FIG. 2 is a plot of high-voltage vs electric spray current for the spray coating apparatus of FIG. 1.

FIG. 2. shows the electric spray current in $\mu$a on the abscissa and the corresponding high voltage in kv on the ordinate. The top function 26 [solid squares] is a standard characteristic line. It shows that in known equipment the electric spray current of the high-voltage electrode rises as the distance between said electrode 10 and object 6 to be coated decreases and how the high-voltage at the same time drops. The high voltage is at its maximum at the largest possible distance away, ie at infinity, of the object 6 to be coated, or another electrically conducting object, from the high-voltage electrode 10.

The center curve 27 [empty squares] relates to an embodiment wherein the maximum DC high voltage of the high-voltage electrode 10 is limited to a maximum value HV-GB of 80 kv, no current limitation I-BG taking place.

The lowermost curve 28 [solid triangles] will materialize in the above circuit of the invention when both the high voltage and the electric spray current are limited to a maximum value each. It was assumes in FIG. 2 that the high-voltage limiting value HV-BG is 50 kv and the electric-spray current limiting value I-BG is 20 $\mu$a ($20\times10^{-6}$ a).

Figure 3:
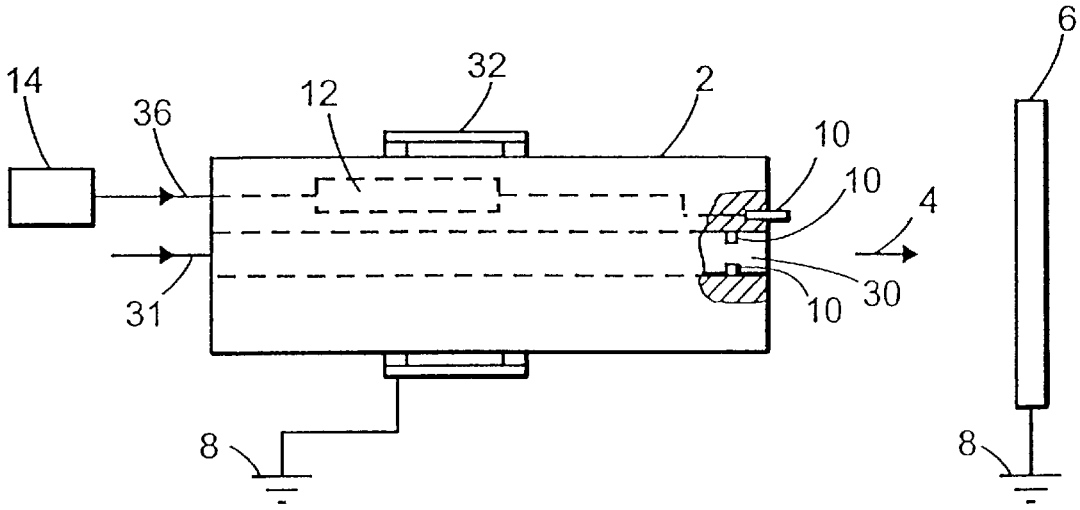
FIG. 3 is a diagram of a spray nozzle of the spray coating apparatus of FIG. 1.

The nozzle 2 is shown is somewhat greater detail in FIG. 3. It shows that one or more high-voltage electrodes can be mounted outside or inside a coating-material duct 30. This duct 30 is loaded with coating material, for instance a coating powder, through a line 31, for instance a hose.

As shown by FIG. 3, the spray nozzle 2 can be fitted with mating electrodes 32 (shunt electrodes) which collect free electrical charges (electrons, ions) discharged from the electrodes 10 and shunt them to ground. It was observed that substantially fewer free electric particles, in particular free ions, are generated in the invention, and that accordingly there is also smaller current leakage.

In FIG. 3 the oscillator 14 is connected by an electric cable 36 to the high-voltage source 12 integrated into the nozzle 2, though it also may be mounted separately from said nozzle, for instance in the regulator system 16.

What is claimed is:

1. A method of ensuring safety in operation of a coating apparatus having a spray nozzle for spraying a coating material onto an electrically conductive object to be coated, at least one electrode for electrostatically charging the coating material sprayed from the spray nozzle, and a voltage source for applying a voltage to the electrode, the voltage causing the electrostatically charged coating material to move towards the object to be coated resulting in a spray current, said method comprising the steps of:

measuring an instant value of the spray current; and regulating the spray current so that the spray current does not exceed a predetermined spray current limiting value by adjusting the voltage applied to the electrode based on the measured instant value of the spray current.

2. The method of claim 1, further comprising the step of controlling the voltage at or below a predetermined voltage limiting value.

3. The method of claim 2, wherein said regulating comprises comparing the measured instant value of the spray current against the spray current limiting value;

generating a voltage regulating value based on said spray current value comparison;

comparing the voltage regulating value against the voltage limiting value;

generating a control voltage based on said voltage value comparison; and using the control voltage to adjust the voltage applied to the electrode.

4. The method of claim 3, wherein said spray current value comparison is implemented using a proportional-integral control.

5. The method of claim 3, wherein the control voltage has a value equal to the smaller of the voltage regulating value and the voltage limiting value.

6. The method of claim 2, wherein the spray current is kept at or below the spray current limiting value which is lower than a short circuit value that the spray current would have if the voltage applied to the electrode had the voltage limiting value and the electrode was in direct electrical contact with the object to be coated.

7. A method of ensuring safety in operation of a coating apparatus having a spray nozzle for spraying a coating material onto an electrically conductive object to be coated, at least one electrode for electrostatically charging the coating material sprayed from the spray nozzle, a voltage source for applying a voltage to the electrode, the voltage causing the electrostatically charged coating material to move to the object to be coated resulting in a spray current, and a regulating circuit connected between the voltage source and the object, said method comprising the steps of:

measuring an instant value of the spray current; and regulating the spray current so that the spray current does not exceed a predetermined spray current limiting value;

wherein said measuring comprises directly determining the instant value of the spray current in a return path from the object to be coated to the regulating circuit of said apparatus; and said regulating comprises adjusting the voltage applied to the electrode based on the measured instant value of the spray current.

8. The method of claim 7, further comprising the step of controlling the voltage at or below a predetermined voltage limiting value.

9. The method of claim 8, wherein said regulating comprises comparing the measured instant value of the spray current against the spray current limiting value;

generating a voltage regulating value based on said spray current value comparison;

comparing the voltage regulating value against the voltage limiting value;

generating a control voltage based on said voltage value comparison; and using the control voltage to adjust the voltage applied to the electrode.

10. The method of claim 9, wherein said spray current value comparison is implemented using a proportional-integral control.

11. The method of claim 9, wherein the control voltage has a value equal to the smaller of the voltage regulating value and the voltage limiting value.

12. The method of claim 8, wherein the spray current is kept at or below the spray current limiting value which is lower than a short circuit value that the spray current would have if the voltage applied to the electrode had the voltage limiting value and the electrode was in direct electrical contact with the object to be coated.

* * * * *